US007866967B2

(12) United States Patent
Heidemeyer

(10) Patent No.: US 7,866,967 B2
(45) Date of Patent: Jan. 11, 2011

(54) PUMP HAVING AN INTERMEDIATE ELEMENT WITH A PIVOT BEARING WITHIN A ROTOR FOR CONNECTING THE ROTOR WITH A COUPLING DEVICE

(75) Inventor: Christoph Heidemeyer, Remscheid (DE)

(73) Assignee: Luk Automobiltechnik GmbH & Co. KG, Hueckeswagen (DE)

( * ) Notice: Subject to any disclaimer, the term of this patent is extended or adjusted under 35 U.S.C. 154(b) by 868 days.

(21) Appl. No.: 11/666,048

(22) PCT Filed: Sep. 28, 2005

(86) PCT No.: PCT/DE2005/001718

§ 371 (c)(1),
(2), (4) Date: Apr. 19, 2007

(87) PCT Pub. No.: WO2006/042493

PCT Pub. Date: Apr. 27, 2006

(65) Prior Publication Data

US 2008/0008615 A1 Jan. 10, 2008

(30) Foreign Application Priority Data

Oct. 22, 2004 (DE) ..... 10 2004 051 475

(51) Int. Cl.
*F04C 2/00* (2006.01)
*F04C 18/00* (2006.01)

(52) U.S. Cl. ..... 418/255; 418/152; 418/179; 418/234; 417/363; 417/423.1

(58) Field of Classification Search ..... 418/152, 418/156, 178, 179, 234, 255, 256; 464/51, 464/100, 101, 106; 417/363, 364, 423.1
See application file for complete search history.

(56) References Cited

U.S. PATENT DOCUMENTS

| | | | | |
|---|---|---|---|---|
| 5,707,222 | A | 1/1998 | Otto | 418/255 |
| 6,648,619 | B2 * | 11/2003 | Otto | 418/152 |
| 6,749,411 | B1 * | 6/2004 | Lee | 418/256 |
| 7,115,038 | B2 * | 10/2006 | Agner | 464/162 |

FOREIGN PATENT DOCUMENTS

| | | |
|---|---|---|
| DE | 85 09 505 U1 | 1/1986 |
| EP | 0 745 525 | 12/1996 |
| EP | 1 361 365 | 11/2003 |
| WO | WO 2007045193 A1 * | 4/2007 |

* cited by examiner

*Primary Examiner*—Theresa Trieu
(74) *Attorney, Agent, or Firm*—Davidson, Davidson & Kappel, LLC

(57) ABSTRACT

A pump, in particular a vacuum pump for motor vehicles, wherein a rotor with at least one vane is mounted inside a pump housing, the rotor being rotatably driven by the combustion engine of the motor vehicle via a coupling device. An intermediate element is arranged between the rotor and the coupling device so as to captively retain the rotor and coupling device and protect them against wear.

19 Claims, 4 Drawing Sheets

PUMP HAVING AN INTERMEDIATE ELEMENT WITH A PIVOT BEARING WITHIN A ROTOR FOR CONNECTING THE ROTOR WITH A COUPLING DEVICE

The present invention relates to a pump, in particular a vacuum pump for motor vehicles, in which a rotor having at least one vane is rotatably driveably supported within a pump housing and is rotatably driven by the combustion engine of the motor vehicle via a coupling device, and in which an intermediate element is disposed between the rotor and the coupling device so as to provide a captive connection and wear protection between the rotor and the coupling device.

BACKGROUND

Pumps of this kind are generally known. However, they have the disadvantage that the intermediate element secures the coupling device to the rotor in such a manner that the coupling device is only able to perform a translational movement, but not a pivoting movement. Therefore, it is not possible to compensate for any misalignment between the driving device and the rotor, which would require the coupling element to perform a pivoting movement.

SUMMARY OF THE INVENTION

It is an object of the present invention to provide a pump which does not have these disadvantages.

The present invention provides a pump, in particular a vacuum pump for motor vehicles, in which a rotor having at least one vane is rotatably driveably supported within a pump housing and is rotatably driven by the combustion engine of the motor vehicle via a coupling device, and in which an intermediate element is disposed between the rotor and the coupling device so as to provide a captive connection and wear protection between the rotor and the coupling device, the intermediate element providing a pivot bearing within the rotor for the coupling device. A pump is preferred in which the intermediate element is designed such that the coupling device does not touch the rotor. This provides the advantage that the intermediate element also provides wear protection in the event of reverse rotation, as may occur when turning off the combustion engine or due to oscillations superimposed on the rotary motion.

A possible feature of a pump according to the present invention may include that the intermediate element is substantially in the form of a cap-shaped sheet-metal part which is disposed in a groove in the rotor and which, on the one hand, provides a captive connection to the coupling device while allowing the coupling device to perform a pivoting movement and, on the other hand, provides a fixed connection to the rotor. A pump is preferred in which the coupling device is substantially in the form of a strip-shaped element including a pivot portion which is rounded at one long side and supported within the intermediate element, and a rectangular engagement portion which is located on the opposite long side and engages with, for example, a groove of a driving device, such as the camshaft of a combustion engine of a motor vehicle.

In a preferred pump, the coupling device is, in addition, provided with lateral recesses into which are snapped the captive connectors of the intermediate element, which are in the form of clipping devices.

Also preferred is a pump in which the coupling device is supported in such a way that it can pivot in the intermediate element in the rotor and move about its longitudinal axis in the groove of the driving device. This provides the advantage that any offset between the drive shaft and the rotor can be compensated for by the pivoting movement on the one hand, and by the translational movement in the groove within the driving device.

It is a feature of a pump according to the present invention that the coupling device is made from sintered steel, or stamped out from bar stock. Also preferred is a pump in which the rotor is made of plastic, preferably PA6.6, or of aluminum.

Further preferred is a pump in which the rotor, the intermediate element, and the coupling device form a captive assembly after they are assembled, in particular after they are clipped together. A pump is preferred in which, after assembly, the components of the assembly are captively but separably connected to each other, the intermediate element having so-called "curved tongues". Further preferred is a pump in which, after assembly, the components of the assembly are inseparably connected to each other, the intermediate element having so-called "hook tongues", which act as barbs.

It is a feature of a pump according to the present invention that the intermediate element is made from sheet metal by stamping and bending. In addition, a pump is preferred in which the intermediate element has cutouts in the short sides and in the region of the rounded bottom, said cutouts allowing for inward flexing movements during insertion of the intermediate element into the rotor groove. Also preferred is a pump in which the intermediate element is clamped by its long sides within the rotor groove, while at its transverse sides, it is clamped, in particular clipped, into the recesses of the coupling device.

BRIEF DESCRIPTION OF THE DRAWINGS

The present invention will now be described with reference to the Figures.

DETAILED DESCRIPTION

Figure 1:
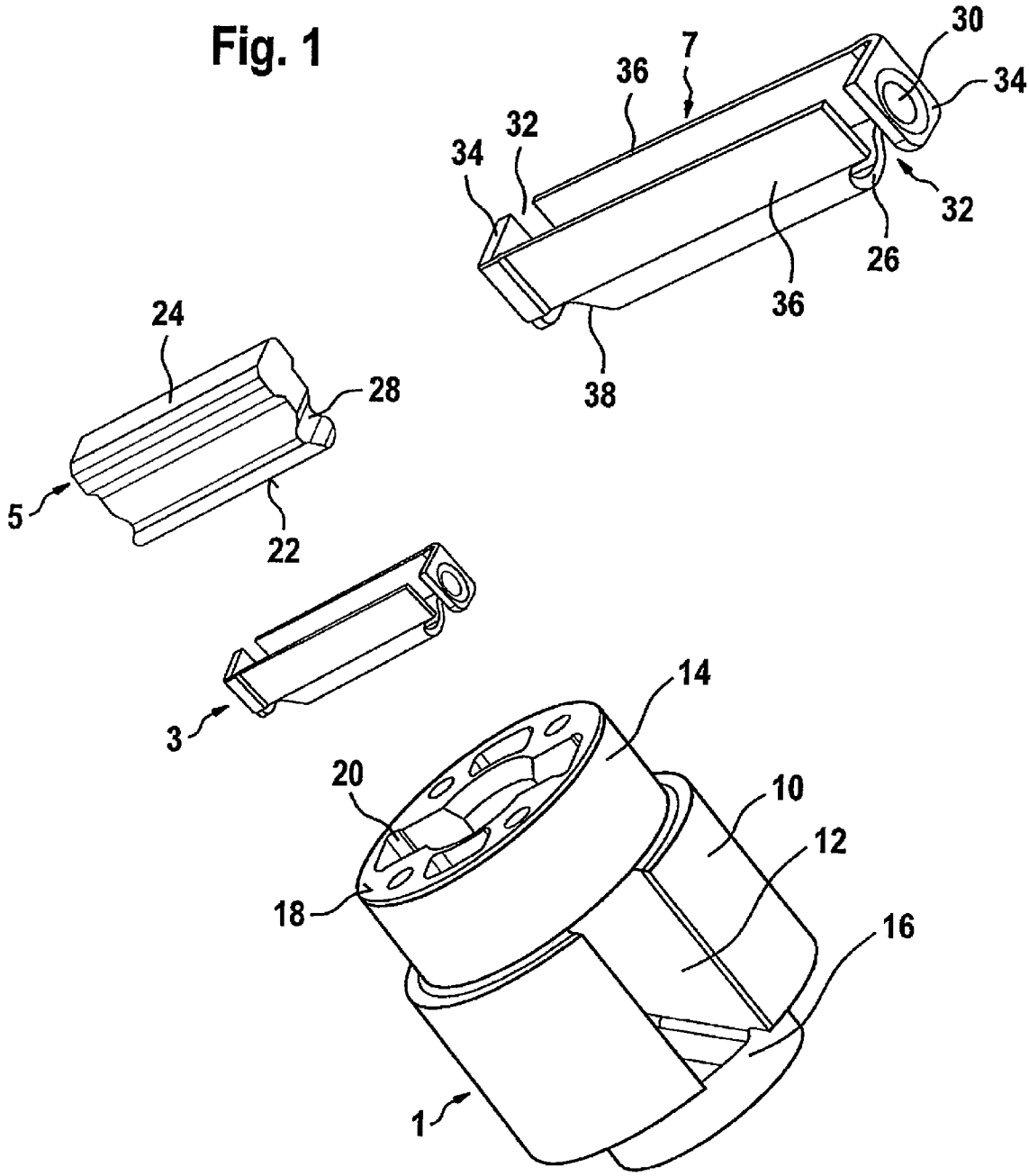
FIG. 1 is a three-dimensional view of the three components, namely the rotor, the intermediate element, and the coupling device.

FIG. 1 is a three-dimensional view showing the three components of the assembly to which the present invention has application, namely a rotor 1 of a vacuum pump, an intermediate element 3, and a coupling device 5. Intermediate element 3 is shown in more detail in enlarged view 7. Rotor 1, which is preferably made of plastic, has a cylindrical portion of greater diameter 10, which has a slot 12 to receive a vane 110. Vacuum pumps constructed in this manner are therefore also called "mono-vane cell vacuum pumps". Rotor 1 further has a cylindrical portion of smaller diameter 14, which also serves as a plain bearing within a pump housing 100. Moreover, rotor 1 has a second cylindrical portion of smaller diameter 16, which serves as a second bearing within the vacuum pump housing. Cylindrical portion 14 has an end face 18 in which is formed a groove 20. Groove 20 serves to receive intermediate element 3 or 7, which can be made, for example, from a sheet iron material or a different metal material by stamping and bending. Intermediate element 3 can be inserted into groove 20 of rotor 1 by a type of resilient clamped connection, as will be described in greater detail hereinafter.

A strip-shaped element is used as the coupling device 5, said strip-shaped element having a rounded longitudinal surface 22 on one long side, and an approximately rectangular engagement portion 24 on the opposite long side. The long side with the rounded pivot portion 22 of coupling device 5 is supported in a rounded bottom portion 26 of intermediate element 7 or 3, and thus can allow for slight pivoting movements of coupling device 5 within intermediate element 7. Via the rectangular engagement portion 24, which projects beyond the intermediate element, the coupling device can be engaged with, for example, a slot of a camshaft, so that rotor 1 of the vacuum pump is rotatably driven by the camshaft, and thus by the combustion engine, via coupling device 5. In order to transmit the occurring driving forces, coupling element 5 is made of a metal material, preferably of sintered metal. Since, in order to reduce the inertial forces, rotor 1 is made of a softer plastic material, direct engagement of coupling device 5 with plastic groove 20 of rotor 1 would result in considerable wear and possibly destruction of the plastic rotor, because coupling device 5 must perform relative movements with respect to both rotor 1 and the driving camshaft in order to compensate for misalignment between camshaft and the plastic rotor. Intermediate element 3 or 7 is needed, inter alia, to avoid this wear problem. To this end, intermediate element 3 or 7 must be fixedly disposed in rotor groove 20, so as to prevent relative movement between intermediate element 3 or 7 and rotor nut 20. However, to be able to use the pivotable coupling element 5, intermediate element 3, 7 must also be designed in such a way that the required pivoting movement can be performed within intermediate element 3, 7. This is ensured by rounded bottom 26 of the intermediate element and rounded long side 22 of coupling device 5. Coupling device 5 further has two additional recesses 28 provided in its short sides. When inserting coupling device 5 into intermediate element 7, two tongues 34 having spherical segment-shaped depressions 30 are resiliently pressed apart, and then snap into recesses 28, thereby captively connecting coupling device 5 to intermediate element 7, which is fixedly seated in plastic rotor 1, while still allowing coupling element 5 to perform a slight pivoting movement within connecting element 7. To allow resilient flexure of the tongues 34 provided with the spherical segment-shaped depressions 30, suitable slots 32 are provided between resilient tongues 34 and longitudinal side walls 36 of intermediate element 7. Moreover, intermediate element 7 has cutouts 38 in its short sides in the region of the rounded bottom, thereby providing both a clearance for resilient movement of tongues 34 and a clearance for resilient clamping movement of side faces 36 in groove 20. Since coupling element 5 is clipped within connecting element 7, coupling element 5 is supported in such a way that it can, in fact, pivot but not move radially within rotor 1. To be able to compensate for axial misalignment between the drive shaft and the pump motor, some radial movement must be allowed between rectangular engagement portion 24 and a corresponding slot in the camshaft of the combustion engine.

Figure 2:
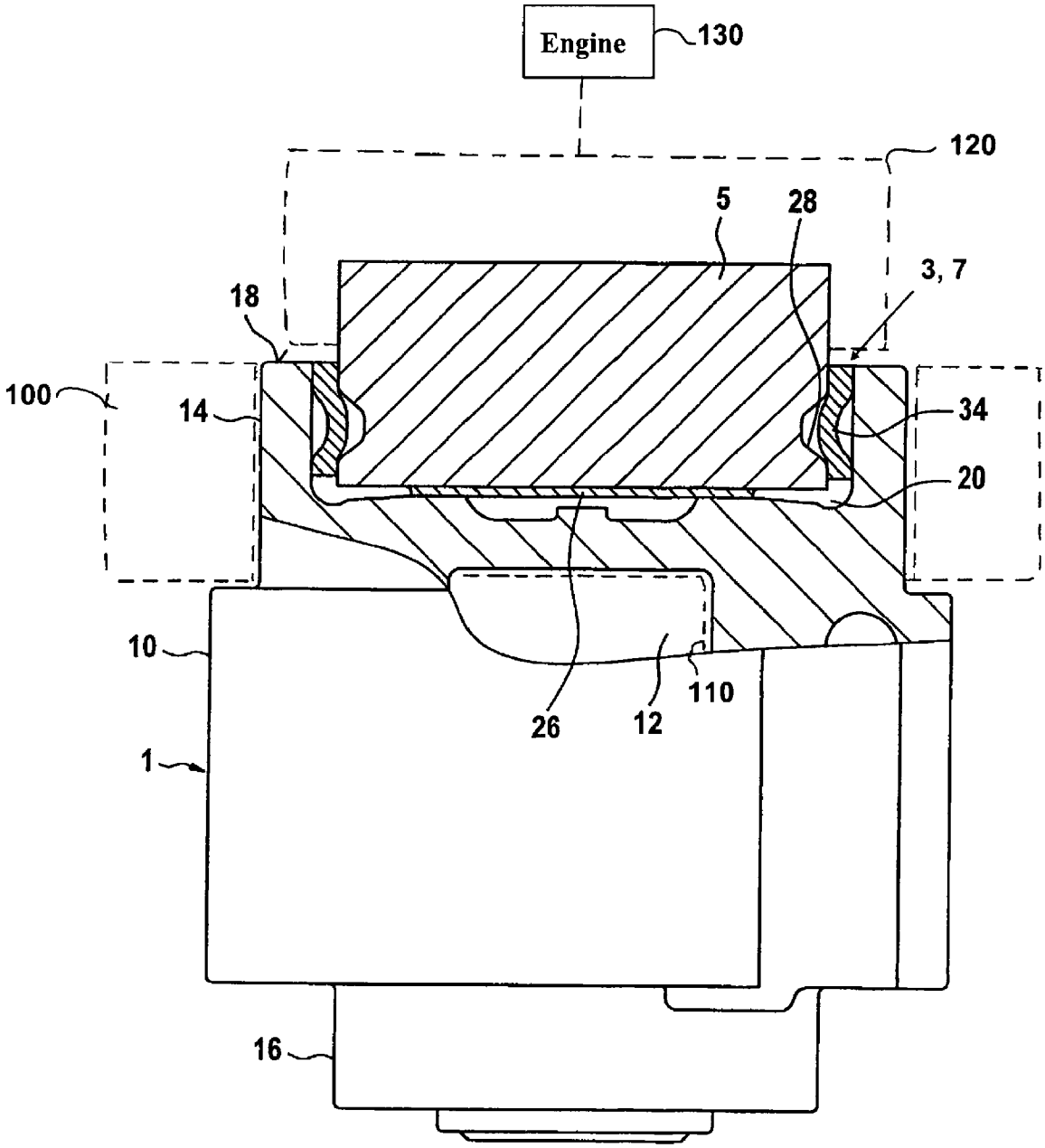
FIG. 2 is a cross-sectional view showing the elements of FIG. 1 in an assembled condition.

FIG. 2 shows in a cross-sectional view the three elements rotor 1, intermediate element 3 or 7, and coupling device 5 in an assembled condition. The cross-sectional view shows particularly well that spherical segment-shaped depressions 30 of intermediate element 3 or 7 snap into recesses 28 of coupling element 5. Furthermore, the cross-sectional view shows particularly well that rounded bottom 26 and the tongues 34 with the spherical segment-shaped depressions 30 prevent contact between coupling element 5 and the walls of groove 20 in plastic rotor 1. Thus, wear is prevented between coupling device 5 and plastic rotor 1, and the maximum permitted surface pressure on the walls of groove 20 of plastic rotor 1 is not exceeded. Housing 100 and vane 110, as well as camshaft 120 and engine 130 are shown schematically.

Figure 3:
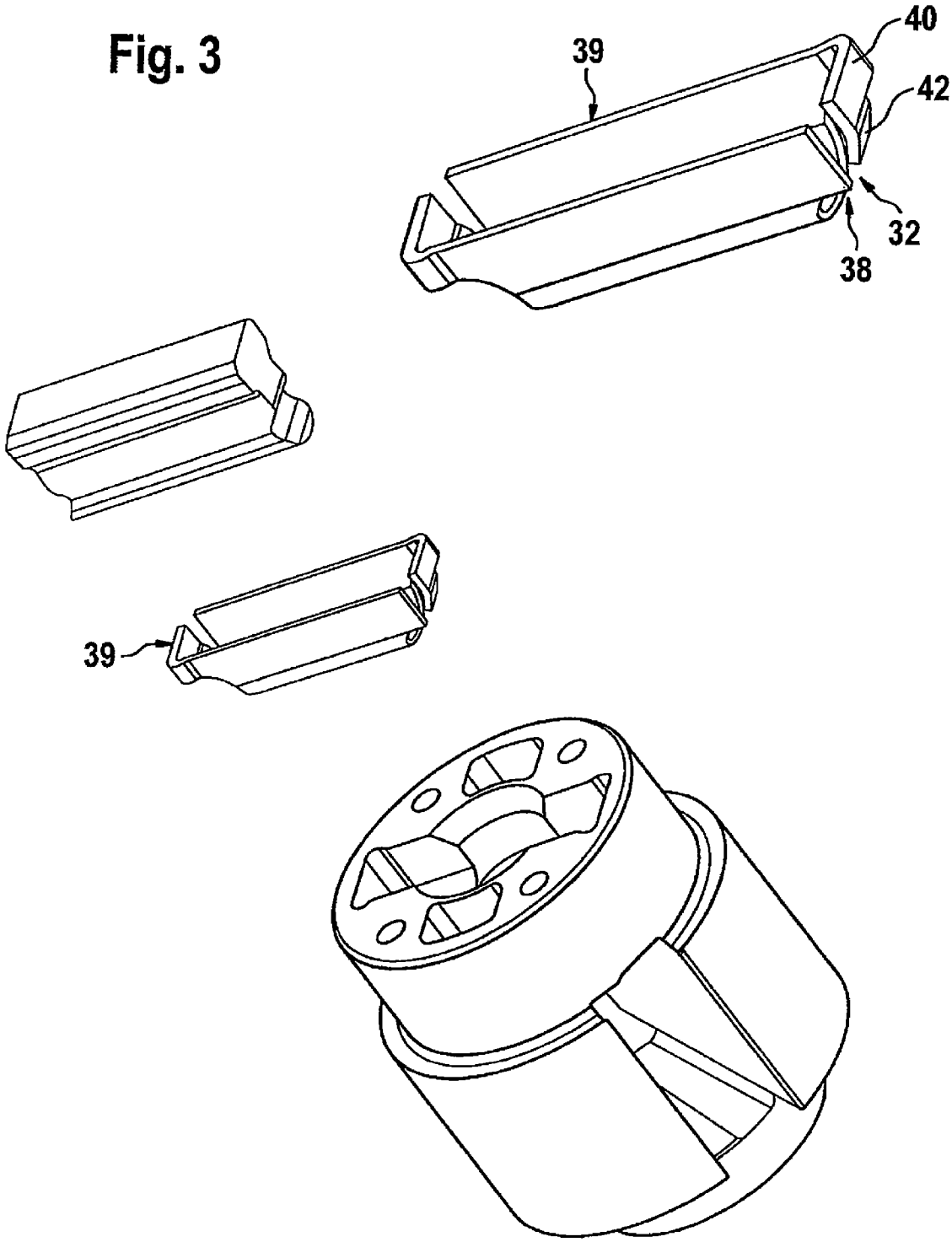
FIG. 3 is a variant of FIG. 1 with a different intermediate element.

FIG. 3 shows the three components of another assembly according to the present invention, which are configured in a manner substantially similar to those in FIG. 1. The difference is in the configuration of intermediate element 39, which now has resilient tongues 40 provided with hook-shaped latching members 42. The required resilient movement is again made possible by cutouts 32 and 38, as already described in FIG. 1.

Figure 4:
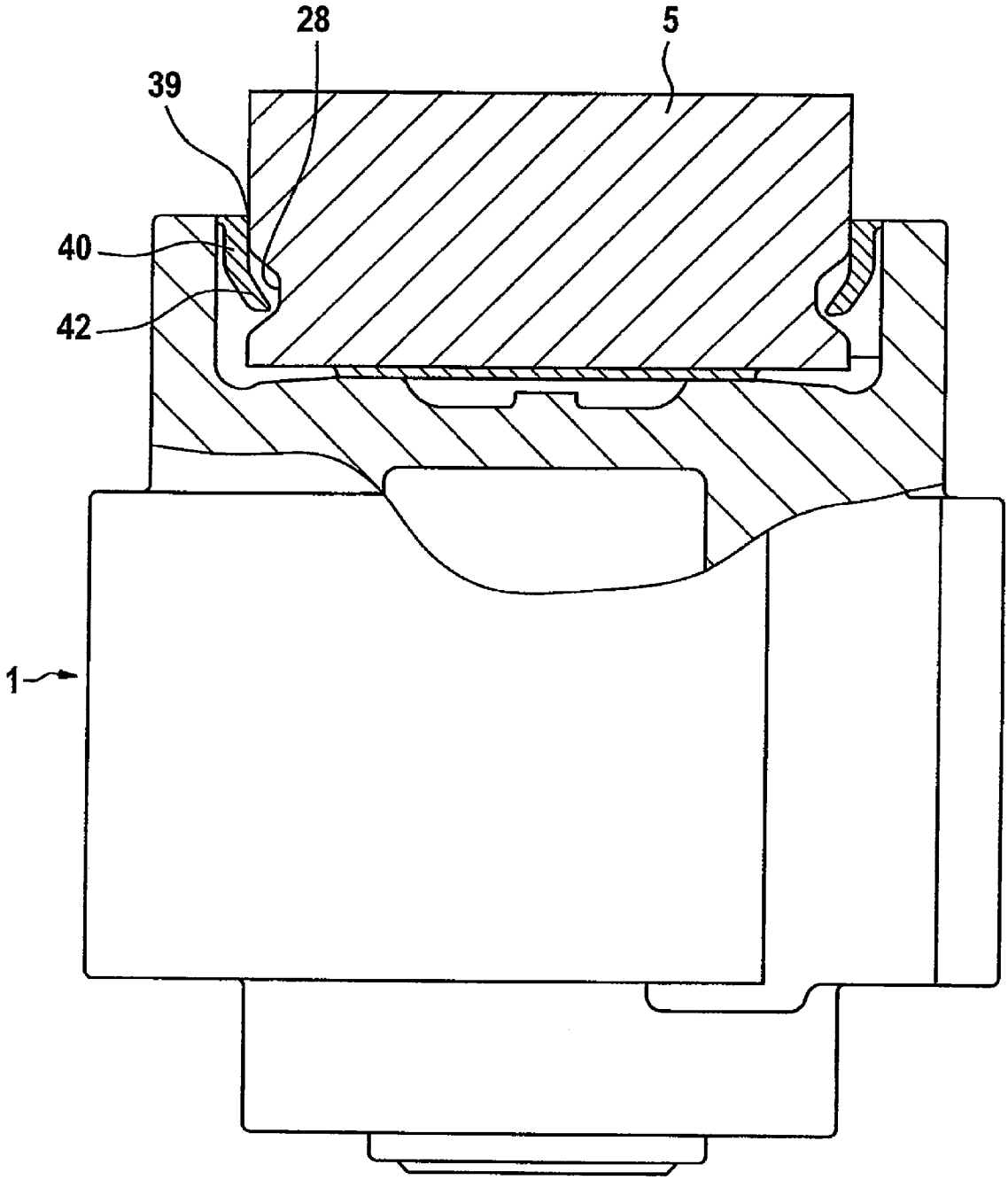
FIG. 4 is a cross-sectional view showing the elements of FIG. 3 in an assembled condition.

In the cross-sectional view of FIG. 4, it can clearly be seen that, in this case, when attempting to extract coupling element 5, the hook-shaped latching members 42, which again snap into recesses 28, would counteract such movement in the manner of barbs. In this case, due to the special shape of latching members 42, the connection provided between coupling device 5, intermediate element 39, and plastic rotor 1 is clippable but cannot be separated anymore after assembly.

Thus, the present invention enables the pivotable drive coupling 5 of a vacuum pump to be mounted captively, in particular in a clipping manner, by applying a slight assembly force. Coupling 5 transmits the rotary motion of a camshaft to rotor 1 via a sheet-metal holder 3, 7, 39 (an insert for reducing wear), and, in addition to performing a pivoting movement, is able to compensate for misalignment in the axial and radial directions. Intermediate element 3, 7, 39, i.e., the sheet-metal holder, can be formed by making a tongue 42, a nose or a curvature 30 in the sheet metal holder in the longitudinal axis of the coupling by means of stamping and bending, and providing a corresponding recess 28 on the coupling for fixating purposes. Intermediate element 3 or 7, i.e., the sheet-metal holder, can be fixed in rotor 1 by resilient longitudinal walls 36, providing a clamped connection or a clipping connection.

LIST OF REFERENCE NUMERALS

1 rotor
3 intermediate element, sheet-metal holder
5 coupling device
7 intermediate element, shown enlarged
10 cylindrical portion of greater diameter
12 vane slot
14 cylindrical portion of smaller diameter
16 second cylindrical portion of smaller diameter
18 rotor end face
20 rotor groove
22 rounded longitudinal surface of the coupling
24 rectangular engagement portion of the coupling
26 rounded bottom portion of the intermediate element
28 lateral recesses of the coupling device
30 spherical segment-shaped depressions of the resilient tongues
32 slots between the resilient tongues and the longitudinal side walls
34 resilient tongues
36 longitudinal side walls of the intermediate element
38 cutouts of the intermediate element
39 different intermediate element
40 resilient tongues of intermediate element 39
42 latching members of the resilient tongues 40

What is claimed is:

1. A pump comprising:

a rotor having at least one vane and being rotatably driveably supported within a pump housing;

a coupling device, the rotor being rotatably driven by a combustion engine of a motor vehicle via the coupling device; and an intermediate element disposed between the rotor and the coupling device so as to provide a captive connection and wear protection between the rotor and the coupling device, the intermediate element providing a pivot bearing within the rotor for the coupling device.

2. The pump as recited in claim 1 wherein the pump is a vacuum pump for a motor vehicle.

3. The pump as recited in claim 1 wherein the intermediate element is configured that the coupling device does not directly contact the rotor.

4. The pump as recited in claim 1 wherein the intermediate element is in the form of a cap-shaped sheet-metal part disposed in a groove in the rotor providing the captive connection to the coupling device and allowing the coupling device to perform a pivoting movement and providing an otherwise fixed connection to the rotor.

5. The pump as recited in claim 1 wherein the coupling device is in the form of a strip-shaped element including a pivot portion rounded at one longitudinal side and supported within the intermediate element, and a rectangular engagement portion located on an opposite longitudinal side and engaging with a driving device driven by the combustion engine.

6. The pump as recited in claim 5 wherein the driving device is a camshaft.

7. The pump as recited in claim 1 wherein the coupling device has lateral recesses, captive connectors of the intermediate element being snapped into the lateral recesses, the captive connectors of the intermediate element being in the form of clipping devices.

8. The pump as recited in claim 1 wherein the coupling device is supported to pivot in the intermediate element in the rotor and move along its longitudinal axis.

9. The pump as recited in claim 1 wherein the coupling device is made from sintered steel, or is a stamped out piece of bar stock.

10. The pump as recited in claim 1 wherein the rotor is made of plastic or of aluminum.

11. The pump as recited in claim 10 wherein the plastic is PA6.6.

12. The pump as recited in claim 1 wherein the rotor, the intermediate element, and the coupling device form a captive assembly once assembled.

13. The pump as recited in claim 12 wherein the assembly is clipped together.

14. The pump as recited in claim 12 wherein after assembly, the components of the assembly are captively but separably connected to each other, the intermediate element having curved tongues.

15. The pump as recited in claim 12 wherein after assembly, the components of the assembly are inseparably connected to each other, the intermediate element having hook tongues acting as barbs.

16. The pump as recited in claim 1 wherein the intermediate element is a stamped and bended sheet metal piece.

17. The pump as recited in claim 1 wherein the intermediate element has cutouts-in the longitudinal sides and in a region of a rounded bottom, the cutouts allowing for inward flexing movements during insertion of the intermediate element into a groove of the rotor.

18. The pump as recited in claim 1 wherein the intermediate element is clamped by its longitudinal sides within a groove of the rotor while at transverse sides, the intermediate element is clamped into recesses of the coupling device.

19. The pump as recited in claim 18 wherein the intermediate element is clipped in via the clamping.

* * * * *